United States Patent [19]

Peterson

[11] 4,265,273

[45] May 5, 1981

[54] HIGH PRESSURE IMPLEMENT CIRCUIT FOR LOADER WITH SLOW AND FAST DUMP POSITION

[75] Inventor: Wayne A. Peterson, Washington, Ill.

[73] Assignee: Caterpillar Tractor Co., Peoria, Ill.

[21] Appl. No.: 80,646

[22] Filed: Oct. 1, 1979

Related U.S. Application Data

[60] Division of Ser. No. 967,345, Dec. 7, 1978, Pat. No. 4,199,293, which is a continuation of Ser. No. 775,062, Mar. 7, 1977, abandoned.

[51] Int. Cl.[3] ..... F15B 13/07

[52] U.S. Cl. ..... 137/625.68; 137/625.69

[58] Field of Search ..... 137/625.68, 625.69

[56] References Cited

U.S. PATENT DOCUMENTS

| | | | |
|---|---|---|---|
| 3,771,564 | 11/1973 | Bianchetta | 137/625.63 |
| 3,869,107 | 3/1975 | Field et al. | 251/297 X |

*Primary Examiner*—Gerald A. Michalsky

*Attorney, Agent, or Firm*—Phillips, Moore, Weissenberger, Lempi & Majestic

[57] ABSTRACT

A loader vehicle includes a loading implement movable to a dump and a rack-back position by means of actuation of cylinders. The movement of the cylinders is provided by fluid control valves in turn operated by actuator means which provide for both a slow dump and a fast dump movement of the implement.

4 Claims, 5 Drawing Figures

HIGH PRESSURE IMPLEMENT CIRCUIT FOR LOADER WITH SLOW AND FAST DUMP POSITION

This is a division, of Ser. No. 967,345, filed Dec. 7, 1978, now U.S. Pat. No. 4,199,293, which is a continuation of Ser. No. 775,062 filed on Mar. 7, 1977, now abandoned.

BACKGROUND OF THE INVENTION

This invention relates to a vehicle including a loading implement, and more particularly, to such a vehicle incorporating a bucket which may be moved in both a slow dump and fast dump mode.

In general, it is well known to provide a vehicle in which cylinders are actuable to move a bucket to a rack-back or dump position. In general, in such a system, the bucket is moved at a substantially constant uniform speed as material is dumped therefrom, through substantially the full dumping travel thereof. It should be understood that, under some operating conditions, in order to improve the efficiency of operation of such an apparatus, it would be highly desirable to selectively provide, rather than a single dumping speed, a relatively slow dumping speed, and a relatively fast dumping speed of the bucket. For example, where the utmost speed of operation is necessary, the operator could with advantage select the fast dumping speed of the bucket. As compared to this, if greater control of the material being dumped is advantageous, the operator could select the slow dumping speed of the bucket.

SUMMARY OF THE INVENTION

The present invention is directed to overcoming one or more of the problems as set forth above.

Accordingly, the present invention is provided in a vehicle having tilt cylinder means actuatable in one and the other directions to move a bucket to a dump position and to a rack-back position respectively. The invention comprises a valve of a hydraulic control system for selectively providing a first, relatively lower speed of movement of the bucket from the rack-back position toward the dump position through actuation of tilt cylinder means, and for selectively providing a second, relatively higher speed of movement of the bucket from the rack-back position toward the dump position through actuation of the tilt cylinder means.

An aspect of the invention includes means for presenting an increased bucket speed during the relatively lower speed of movement of the bucket to the dump position.

Accordingly, the present invention overcomes one or more of the above-referenced problems by providing an hydraulic control system in a vehicle, including a bucket, for dumping material from the bucket in a relatively slow manner, and a relatively fast manner, as selected by the operator of the vehicle.

Further, the present invention provides an hydraulic control system in a vehicle, which system is extremely effective in operation and efficient in design.

BRIEF DESCRIPTION OF THE DRAWINGS

These and other objects of the invention will become apparent from a study of the following specification and drawings, in which.

DESCRIPTION OF THE PREFERRED EMBODIMENT

Figure 1:
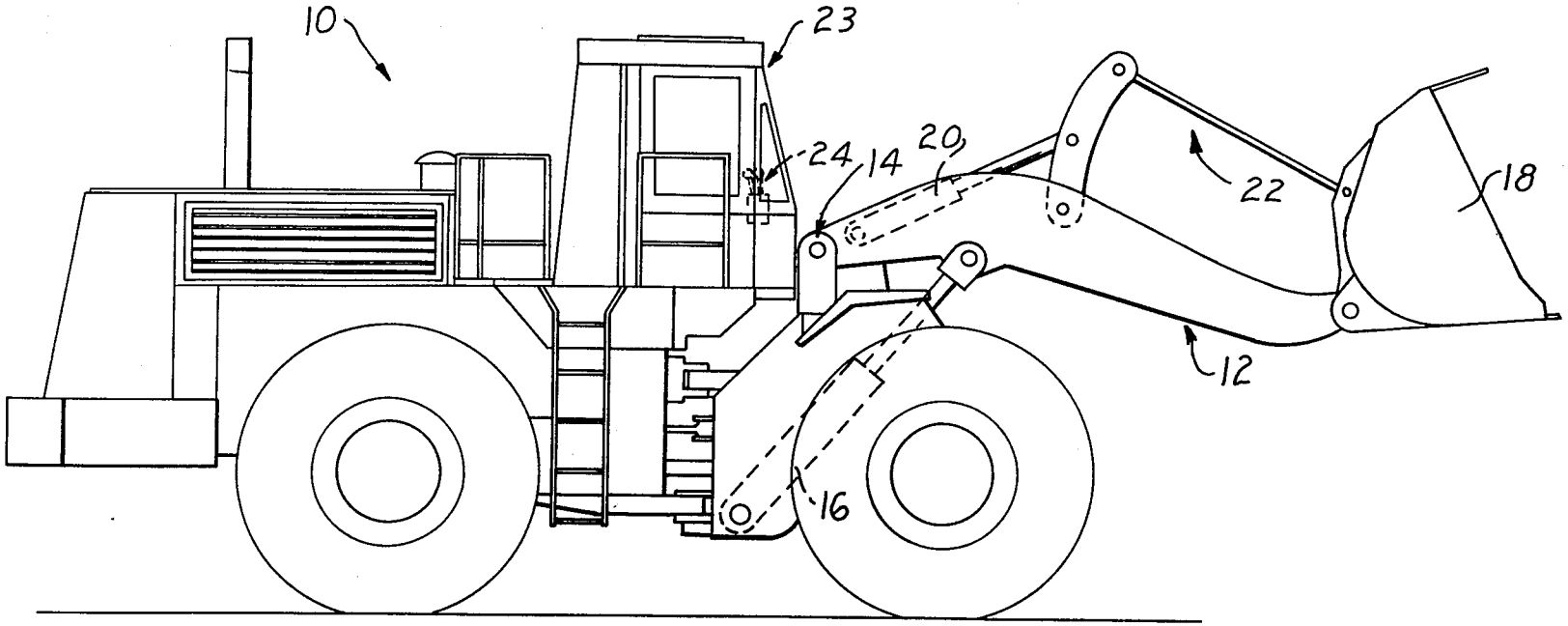
FIG. 1 is a side elevation of a vehicle incorporating the present invention.

Shown in FIG. 1 is a vehicle 10 including lift arms 12 forwardly disposed thereof, pivotally attached to the frame 14 of the vehicle 10, and raisable and lowerable by extension and retraction of lift cylinders (one shown at 16). Pivotally secured to the extended ends of the lift arms 12 is a bucket 18 which may be pivoted in one and the other directions by extension and retraction of tilt cylinders (one shown at 20) operating through a tilt linkage 22, as is well known. It will be seen that extension of these cylinders 20 moves the bucket 18 to a dump position, and retraction of the cylinders 20 moves the bucket 18 to a rack-back position.

Figure 2:
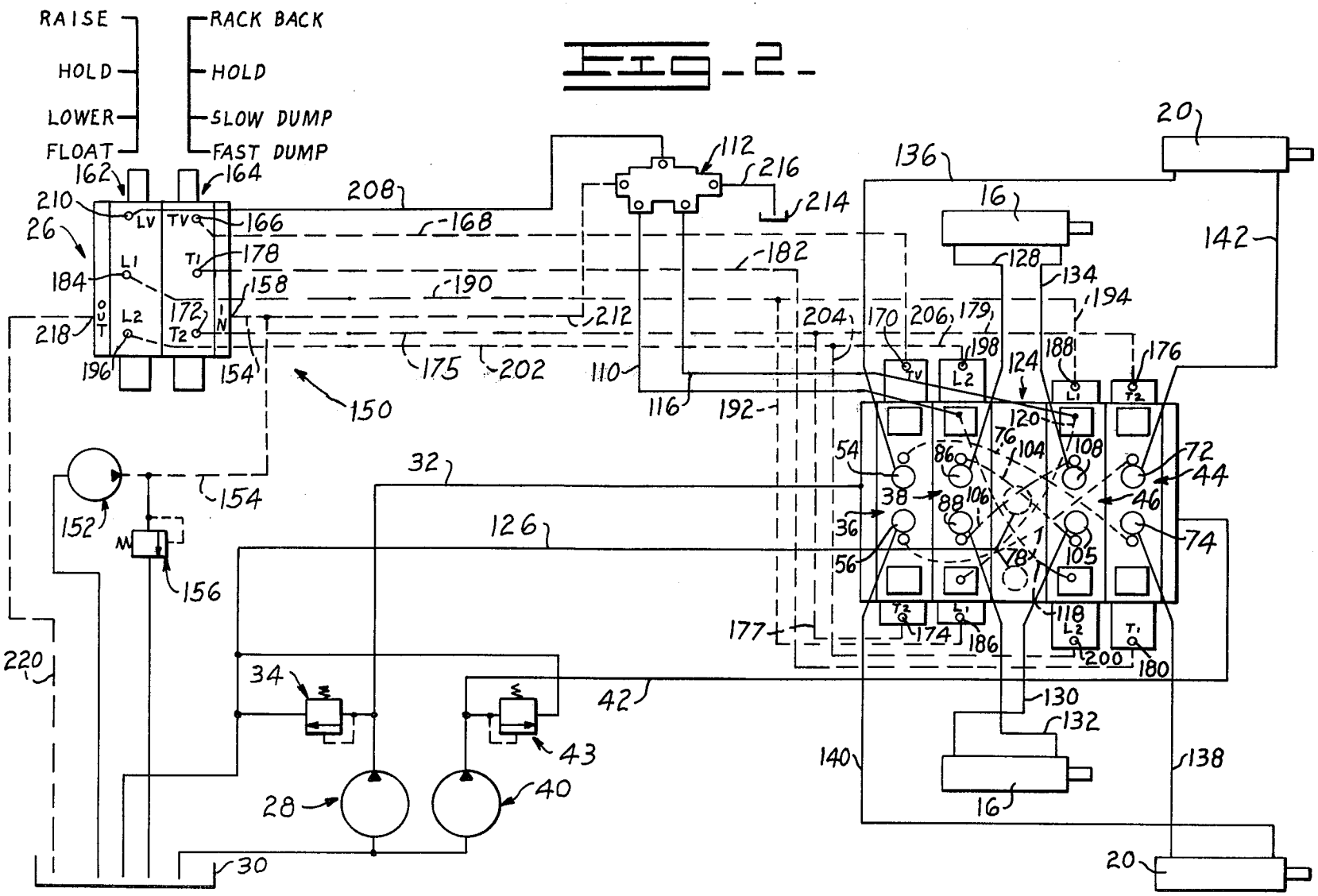
FIG. 2 is a generally schematic representation, with parts in section, of a hydraulic control circuit incorporating the invention.
Figure 3:
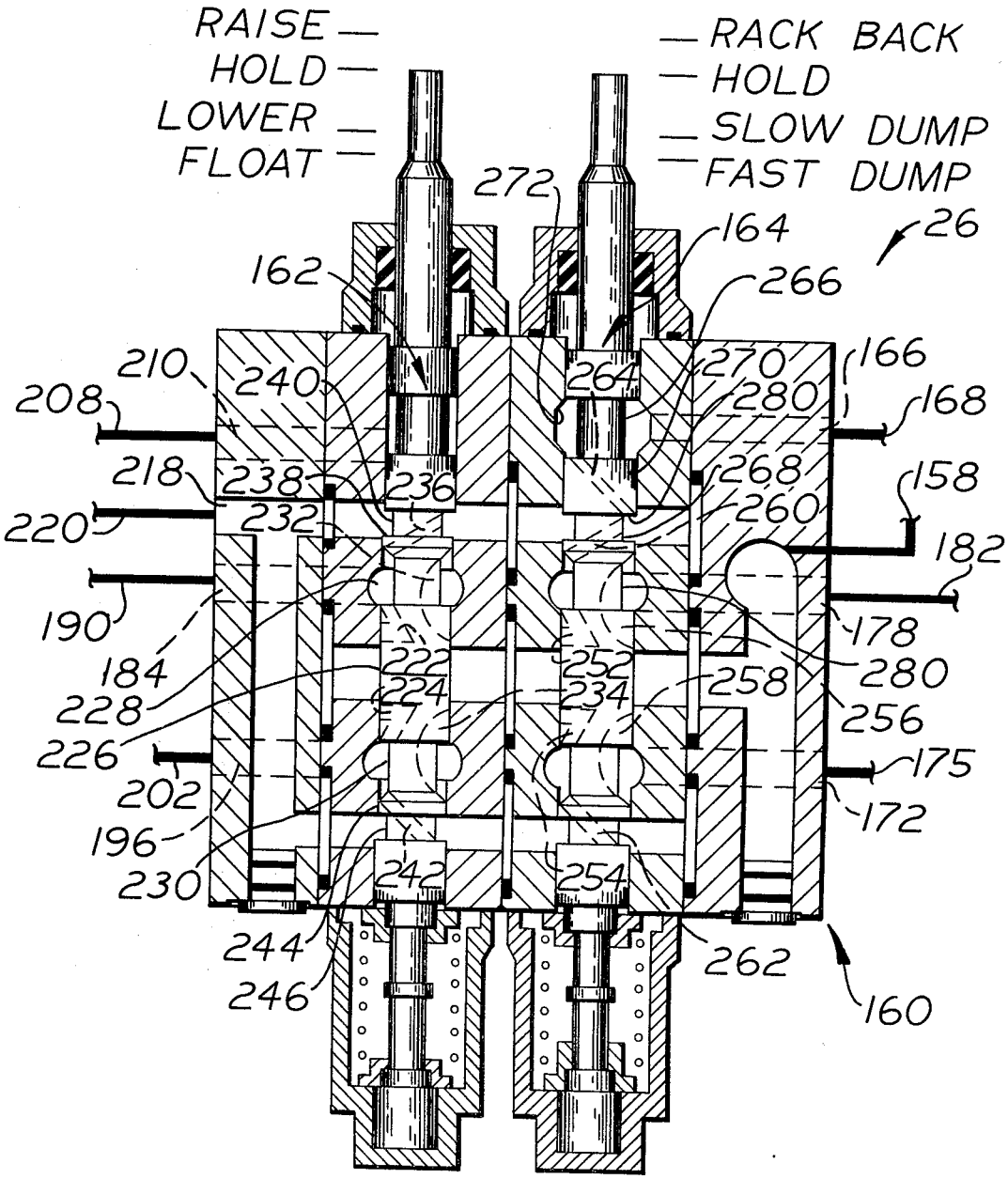
FIG. 3 is a fragmentary view, with parts in section, of a portion of the control circuit of FIG. 2.

The vehicle 10 includes an operator's station 23, with operator controls 24 for selectively actuating the lift and tilt cylinders 16,20. The operator controls 24 include actuator valve means 26 as shown in FIGS. 2 and 3, readily accessible to the operator of the vehicle 10, the construction and operation of which will be described in detail further on.

A first fixed displacement implement fluid pump 28 draws fluid from a reservoir 30 through a conduit 32, past a main relief valve 34, and to a pair of control valves 36,38. A second fixed displacement implement fluid pump 40 draws fluid from reservoir 30 through a conduit 42 past a main relief valve 43 to a second pair of control valves 44,46.

Figure 4:
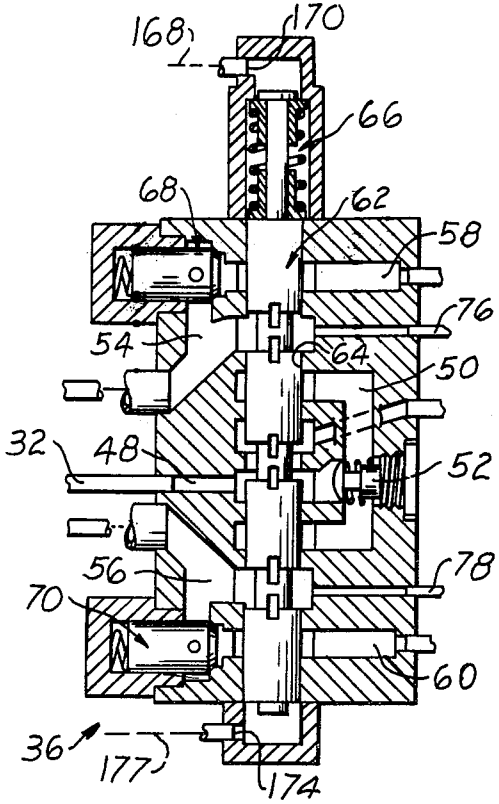
FIG. 4 is a fragmentary view, with parts in section, of another portion of the control circuit of FIG. 2.

The control valve 36 (FIG. 4) has an inlet port 48 for receiving fluid from the conduit 32. The inlet port 48 is in communication with a branched supply conduit 50 by means of an inlet check valve 52. The valve 36 also includes a pair of service ports or chambers 54,56 spaced apart on opposite sides of branched conduit 50 with drain ports 58,60 being arranged respectively adjacent the service ports 54,56. A valve spool 62 is slidably arranged within a bore 64 to selectively regulate communication of the service ports 54,56 with either the branched supply conduit 50 or the drain ports 58,60. The valve spool 62 is shown in a neutral position under the influence of a centering spring mechanism 66 where both the service chambers 54,56 are blocked from communication with either the supply conduit 50 or the drain ports 58,60. Makeup valves 68,70 respectively provide communication between the service ports 54,56 and the drain ports 58,60 whenever fluid pressure in one of the service ports is less than the fluid pressure in the drain passages.

The control valve 36 is operatively associated with the control valve 44, which control valves 36, 44 are similar in construction, to the valve disclosed in U.S. Pat. No. 3,847,059 (assigned to the assignee of this invention), which patent is incorporated by reference herein. The control valve 44 also, of course, includes service ports 72,74, generally shown in FIG. 2. In accordance with the disclosure of U.S. Pat. No. 3,847,059, an equalizing conduit 78 communicates between the service ports 56,72, while a similar equalizing conduit 76 communicates the service ports 54,74. These conduits 76,78 assure equal pressure to the head ends and rod ends respectively of the cylinders 20, in accordance with such U.S. Pat. No. 3,847,059, as will be further discussed.

Figure 5:
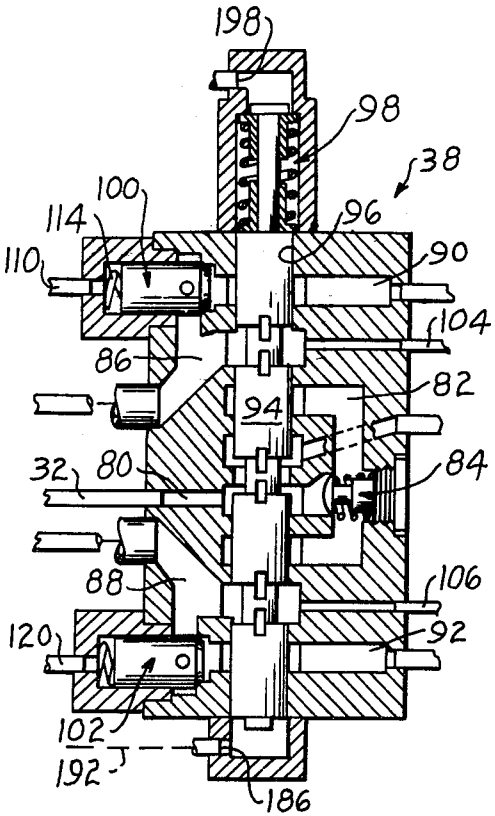
FIG. 5 is a fragmentary view, with parts in section, of yet another part of the control circuit of FIG. 2.

Shown in FIG. 5 is the control valve 38. As shown therein, and similar to the control valve 36, the control valve 38 has an inlet port 80 for receiving fluid from the conduit 32. The inlet port 80 is in communication with a branched supply conduit 82 by means of an inlet check valve 84. The valve 38 also includes a pair of service ports or chambers 86,88 spaced apart on opposite sides of branched conduit 82 with drain ports 90,92 being arranged respectively adjacent the service ports 86,88. A valve spool 94 is slidably arranged within a bore 96 to selectively regulate communication of the service ports 86,88 with either the branched supply conduit 82 or the drain ports 90,92. The valve spool 94 is shown in a neutral position under the influence of a centering spring mechanism 98 where both of the service chambers 86,88 are blocked from communication with either the supply conduit 32 or the drain ports 90,92. Makeup valves 100,102 respectively provide communication between the service ports 86,88 and the drain ports 90,92, whenever fluid pressure in one of the service ports 86,88 is less than the fluid pressure in the drain passages. Similar to the above description, the control valve 46 is generally identical to the control valve 38, and the control valves 38,46 are paired in a manner as disclosed in U.S. Pat. No. 3,847,059. Equalizing conduit 104 provides communication between the service ports 86,105 of the respective control valves 38,46, and equalizing conduit 106 provides communication between the service ports 88,108 of the respective control valves 38,46.

A conduit 110 communicates a three-way vent valve 112 with the back chamber 114 of the valve 100, and a conduit 116 communicates the valve 112 with a back chamber of a makeup valve in control valve 46. A cross-conduit 118 provides communication between the back chamber 110 of control valve 38 and the corresponding back chamber of control valve 46. A cross-conduit 120 provides communication between the back chamber 122 of control valve 38 and the corresponding back chamber of control valve 46. The center portion 124 of the entire control valve assembly 36,38,44,46 is a common drain manifold which communicates with tank 30 through a conduit 126, again generally similar to the apparatus disclosed in U.S. Pat. No. 3,847,059. Each of the drain conduits of the individual control valves 36,38,44,46 communicates with this manifold 124.

As shown in FIG. 2, the service ports 86,105 communicate with the head ends of the lift cylinders 16 through conduits 128,130, and the service ports 88,108 communicate with the rod ends of the lift cylinders 16 through conduits 132,134. The service ports 54,74 communicate with the head ends of the tilt cylinders 20 through conduits 136,138, and the service ports 56,72 communicate with the rod ends of the tilt cylinders 20 through conduits 140,142.

A pilot pressure system 150 includes a pilot pump 152 which communicates through a conduit 154 to the actuator valve 26 shown in FIG. 3. Such conduit 154 feeds over a pilot pressure relief valve 156 or to a pilot supply pressure port 158. Valve body 160 (FIG. 3) of actuator valve means 26 has first and second valve spools 162,164 reciprocable therein. The valve body 160 also includes a port 166 communicating with one end 170 of the control valve 36 through a conduit 168, and a port 172 which communicates with the opposite end 174 of the control valve 36 and also the end 176 of the control valve 44 through conduit 175 and branch conduits 177,179. The valve body 160 further defines a port 178 which communicates with the opposite end 180 of the control valve 44 through a conduit 182.

The actuator valve body 160 also defines a port 184 which communicates with the end 186 of the control valve 38, and the end 188 of the control valve 46, through conduit 190 and branch conduits 192,194. The body 160 defines a port 196 which communicates with the end 198 of the control valve 38 and the end 200 of the control valve 46, through a conduit 202 and branch conduits 204,206. A conduit 208 interconnects a port 210 of the body 160 and the valve 112, and pilot pressure is supplied to the valve through a conduit 212. The valve 112 also communicates with tank 214 through a conduit 216.

The body 160 also defines an outlet port 218 communicating with tank 30 through a conduit 220.

The spool 162 is operatively associated with the ports 196,184,218,210, and the spool 164 is operatively associated with the ports 166,158,178,172. For description of operation of an actuator valve generally similar to actuator valve 26, reference is made to U.S. Pat. No. 3,869,107, assigned to the assignee of this invention, which patent is incorporated by reference herein. It is noted, however, that the present invention does not include hydraulic detents as disclosed in U.S. Pat. No. 3,869,107.

In accordance with U.S. Pat. No. 3,847,059, (incorporated by reference herein) pilot pressure applied to one or the other side of each control valve 36,38,44,46 (which control valves are disclosed in U.S. Pat. No. 3,847,059) will shift the spool operatively associated therewith in a manner to provide appropriate communication between certain ports for actuating the tilt and lift cylinders 20,16.

The spool 162 and its association with the ports 196,184,218,210 generally follows the construction and operation of the spools in U.S. Pat. No. 3,771,564, assigned to the assignee of this invention. As described therein, the spool 162 defines drilled passages 222,224 and metering slots 232,234 extending from the land 226 into the recessed portions 228,230 respectively. An orifice 236 extends through the body of the spool 162, from one side of a land 238 to the other side thereof, communicating a recess 240 of the spool 162 with recess 228. Likewise, an orifice 242 is defined by the spool 162, and extends therethrough from one side of a land 244 to the other, communicating the recess 230 with a recess 246. The spool 162 is shown in its neutral or "hold" position, wherein pilot pressure is blocked from communication with any of the ports. It will therefore be seen that no pilot pressure is applied to either of the control valves 38,46, with which the spool 162 is operatively associated.

Movement of the spool 162 in an upward direction to a raise position provides communication of pilot pressure with the port 196, the orifices 224,234 providing close control and modulation of such pressure during movement of the spool 162, the orifice 242 being of small enough diameter to provide pressure build up in the port 196 to provide pilot pressure to the conduit 202, and to the control valves 38,46, in accordance with U.S. Pat. No. 3,771,564.

The application of pilot pressure to the control valves at ends 198 and 200 provides for shifting of the spools thereof in accordance with U.S. Pat. No. 3,847,059 to supply pressurized fluid to the head ends of the lift cylinders 16, to extend the lift cylinders 16, to in turn raise the lift arms 12 of the vehicle 10. Supply pressure to the cylinders is equalized by conduit 104. The rod ends of the lift cylinders 16 are relieved through control valves 38,46.

Returning the spool 162 to the "hold" position, of course, again blocks off pilot pressure from any of the ports, and also provides that none of the ports communicating with the lift cylinders 16 communicates with tank, so that the lift arms 12 are held in position relative to the vehicle.

In order to lower the arms 12, the spool 162 is moved to the lower position, wherein pilot pressure is supplied to the port 184, in turn supplying pilot pressure to the control valves 38,46 at ends 186 and 188, to retract the cylinders 16, to in turn lower the lift arms 12 of the vehicle 10. The equalizing conduit 106 assures equal pressurization in the rod ends respectively of these cylinders 16, in accordance with U.S. Pat. No. 3,847,059.

During operating conditions, the chamber 114 of the makeup valve 100 in control valve 38 and the corresponding back chamber of control valve 46 communicate with the pilot valve port 210. This is accomplished through conduits 118, 110, vent valve 112 and conduit 208. If the spool 162 is moved to the float position, the port 218 communicates with port 210 so that the pressure in the chambers behind the makeup valves is relieved allowing them to open.

The spool 164 is generally identical with the spool 162, including orifices 252,254,256,258,260,262 corresponding to orifices 222,224,232,234,236,242, and also another orifice 264 communicating the recessed area 266 with the recessed area 268 from one side of a land 270 to the other. Additionally, the body defines an annular chamber 272, which communicates with port 166.

The spool 164 is shown in the first or "hold" position, wherein fluid pressure is blocked from communication with any of the ports, so that no pilot pressure is applied to the control valves 36,44. Movement of the spool 164 to a rack-back position provides for communication between the port 158 and port 172, the orifice 262, of course, being sufficiently small to provide pressure buildup in the port 172, to in turn supply pilot pressure to the end 174 of the control valve 36 and the end 176 of the control valve 44, to in turn supply fluid pressure to the rod ends of the cylinders 20. Conduit 78 provides for equalization of supply pressure to the rod ends of the cylinders 20. The head ends of the cylinders 20 are communicated to tank through control valves 36,44, so that the cylinders 20 are retracted, moving the bucket 18 to a rack-back position. The rod ends of the cylinders 20 are relieved through conduits 142,140. If the spool is placed in the "hold" position, pilot fluid pressure is blocked from communication with the control valves 36,44, and the bucket 18 is held in position.

If the spool 164 is moved to the second or slow dump position, fluid pressure is supplied through the orifice 252 and orifice 256 to the recess 280, and to the port 178, it being remembered that the cross-section of the orifice 260 is small enough to provide pressure buildup in the port 178. Such pressure is communicated to end 180 of the control valve 44 through conduit 182, providing movement of the spool therein to in turn direct fluid pressure to the head end of the tilt cylinder 20 shown in the lower right of FIG. 2. Such pressure is communicated from the service port 74 to the service port 54 through conduit 76, and through conduit 136 to the head end of the other tilt cylinder 20 (upper right in FIG. 2). The pressure supplied to the head ends of these cylinders is supplied only by the pump 40, the pump 28 being blocked from communication with the tilt cylinders 20, since the other control valve 36 operatively associated with the tilt cylinders 20 is not actuated. That is, only one of the two pumps is used to extend the tilt cylinders 20 to in turn move the bucket 18 toward a dump position, thus providing a relatively low speed of movement of the bucket 18 from the rack-back position toward the dump position. The rod ends of these cylinders are, of course, relieved of pressure through the conduits 142,140.

If a relatively higher speed of movement of the bucket 18 from the rack-back position toward the dump position is desired, the valve spool 164 is moved to a third or fast dump position.

With the spool 164 moved to such position, communication of fluid pressure is still provided to the port 178, and the shoulder 280 has been brought against the portion of the body 160, so that the orifice 260 no longer communicates with tank. Pressure supplied through orifice 260 is thereby supplied through orifice 264 to annular chamber 272, and to port 166. Thus, pilot pressure is now supplied to port 166 and port 178 at the same time, so that pilot pressure is supplied to both the end 170 of the control valve 36 and the end 180 of the control valve 44 simultaneously. The control valves 36,44 are thereby actuated together so that the pumps 28,40 both supply pressurized fluid to the head ends of the cylinders 20, so that a relatively higher speed of movement of the bucket 18 from the rack-back position towards the dump position thereof is provided. Throughout such dumping, the conduit 76 provides for equal pressurization of the head ends of the cylinders 20, with the rod ends being relieved through conduits 142,140.

In the condition wherein a heavy load is being dumped in a slow dump state, the bucket 18 has a tendency to be moved to dump faster than the pump is supplying fluid thereto. Because only one spool has been moved, all of the flow from both tilt cylinders must return through the slots in only one control valve, control valve 44. The flow from one of the tilt cylinders is further restricted by having to pass through the relatively small line 78. Thus, good modulation during the slow dump phase is provided.

It will, therefore, be seen that both relatively slow and relatively fast dumping speeds of the bucket 18 are provided, as chosen by the operator, to in turn provide a very high degree of efficiency of use of the apparatus.

The embodiments of the invention in which an exclusive property or privilege is claimed are defined as follows:

1. A valve comprising a valve body and a valve spool movable therein, wherein the body defines a pilot supply pressure port, a first port, a second port and a tank port, and wherein the spool defines a first passage means for providing communication between the pilot supply pressure port and first port as the spool is moved in one direction to a first position relative to the body, wherein the spool further defines means for communicating said first port and said tank port, said communicating means including a means for restricting communication between the first port and tank port, said means for restricting determining pressure buildup in the first port with the spool in said first position, wherein the spool further defines a second passage, further movement of the spool in said one direction providing blocking of the communicating means including the means for restricting from the tank port and providing communication of the means for restricting with the second port through the second passage, with communication between the pressure port and first port continued.

2. The valve of claim 1 wherein said first passage means includes an orifice.

3. The valve of claim 1 wherein said means for restricting includes a restrictive orifice.

4. The valve of claim 1 wherein said second passage includes an orifice.

* * * * *